United States Patent [19]

Miller

[11] 4,411,119

[45] Oct. 25, 1983

[54] METHOD OF LAYING BRICK FOR SWIMMING POOL PATIOS AND THE LIKE

[76] Inventor: Richard L. Miller, 233 Broadway, Room 3612, New York, N.Y. 10007

[21] Appl. No.: 207,765

[22] Filed: Nov. 17, 1980

[51] Int. Cl.[3] ..... E04H 3/16

[52] U.S. Cl. ..... 52/747; 4/506; 52/169.7; 404/34

[58] Field of Search ..... 52/608, 169.13, 249, 52/747, 245, 741, 311, 315, 390, 176, 169.7; 404/34, 42; 4/488, 506, 514, 513

[56] References Cited

U.S. PATENT DOCUMENTS

| | | | |
|---|---|---|---|
| 329,012 | 10/1885 | Cargill et al. | 404/42 |
| 2,493,458 | 1/1950 | Koenig | 404/42 |
| 2,818,248 | 12/1957 | Kelsey | 52/245 |
| 3,466,817 | 9/1969 | Hagel | 52/176 |
| 4,078,295 | 3/1978 | Koller | 52/745 |

FOREIGN PATENT DOCUMENTS

| | | | |
|---|---|---|---|
| 302511 | 10/1932 | Italy | 404/42 |
| 123291 | 4/1928 | Switzerland | 404/34 |
| 125026 | 5/1957 | U.S.S.R. | 52/245 |

*Primary Examiner*—John E. Murtagh

*Attorney, Agent, or Firm*—Richard L. Miller

[57] ABSTRACT

A method of laying bricks in order to lay a large brick surface; including one or several bricklayers working independently in separate areas, the brick laying at each area including an initial laying of a pointed, wedge-shaped brick with progressively thicker, wedge-shaped bricks adjacent thereto in a row, until attaining a standard brick width, after which all other rows of bricks adjacent to the tapered row of brick thus formed, are made of standard, same width brick; the brick rows of all areas being joined together, so as to form the large brick surface.

3 Claims, 4 Drawing Figures

METHOD OF LAYING BRICK FOR SWIMMING POOL PATIOS AND THE LIKE

BACKGROUND OF THE INVENTION

Heretofore, particularly when laying an endless or circular rows of brick, such as around a periphery of a swimming pool, in order to make a patio around the pool, it has been the custom for the bricklayer to continually have to cut and fit brick when coming to the end of a row. This is a tiring method of work, and is slow due to the time loss in cutting brick. Also such method requiring carrying tools along for cutting the brick to fit in each row. This situation is objectionable, and is therefore in need of an improvement.

SUMMARY OF THE INVENTION

Therefore it is a principal object of the present invention to provide a method of laying brick which is quicker to accomplish so to save on production time and accordingly the cost for such extra time needed.

Yet another object is to provide a bricklaying method that is particularly suitable for laying rows of brick around pool or the like in concentric rows therearound, and which is adaptable for pools of any shape, such as circular, oval, irregular free style shape or the like.

Yet a further object is to provide a bricklaying method that is suitable for building a smokestack chimney with brick rows one upon another, instead horizontally alongside, so that several men spaced apart from each other, around the chimney, can each work only within one area without the need of moving continually all around the chimney.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENT

Figure 1:
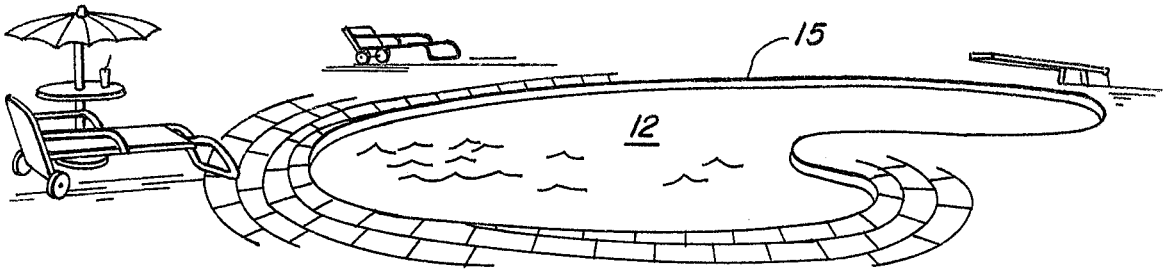
FIG. 1 is a perspective view of a kidney-shaped swimming pool showing the invention incorporated in the pool patio brickwork.
Figure 2:
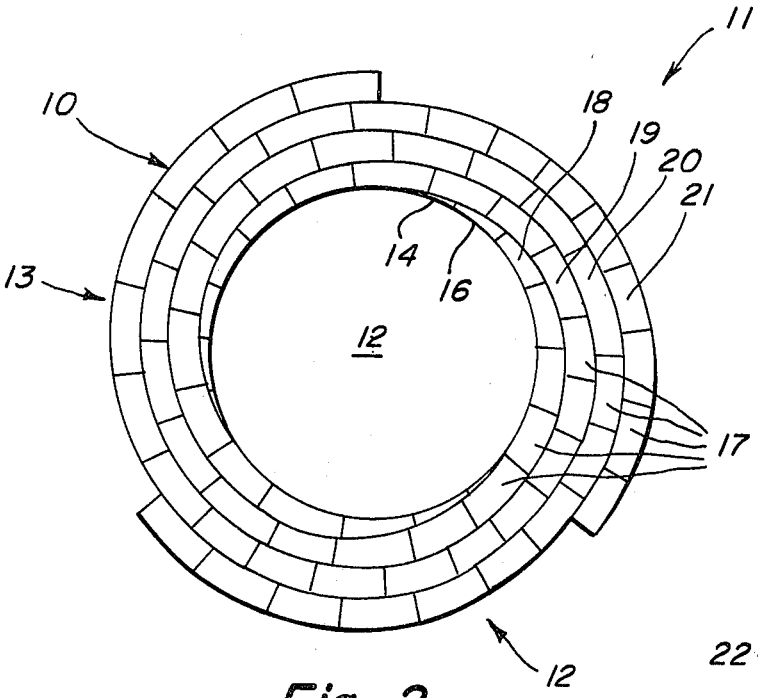
FIG. 2 is a top view of a circular-shaped swimming pool shown incorporating the present invention.
Figure 4:
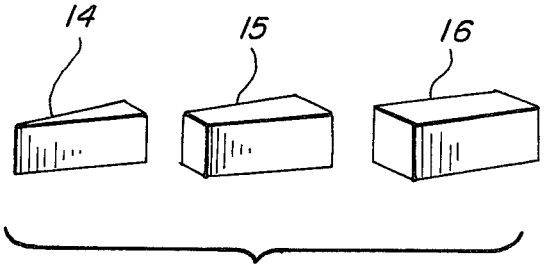
FIG. 4 is a view of several of the typical bricks used in the present invention.

Referring now to the drawing in greater detail, and more particularly to FIGS. 1, 2 and 4 thereof, at this time, the reference numeral 10 represents a patio around a swimming pool 11, and which is laid according to the present invention, wherein either one or several bricklayers worked independently in several, spaced areas 11, 12 and 13 without the necessity of cutting bricks when moving from one area to another.

In so doing, the bricklayer at each area, starts with a pointed, wedge shaped brick 14, laying it adjacent the swimming pool coping 15. He then proceeds to lay a second brick 16 adjacent thereto in a row, the second brick tapering to align with the sides of the first brick. Progressively he then lays a third and fourth tapering, wedge shaped brick, if needed, until the end of this tapering row attains a width that is equal to the width of the standard conventional bricks 17 that will then be used so as to complete the patio construction and which are then laid adjacent the end of the tapered row 18 and also in subsequent rows 19, 20, 21 and the like.

As the bricklaying work progresses at each area 11, 12 and 13, it will be noted that the brick rows of one area will join with the brick rows of an adjacent area, so as to complete the patio 10. It is to be noted, that instead of endless rows of bricks, this method results in a plurality of spiral rows adjacent each other. No brick cutting tool is needed on the job.

Figure 3:
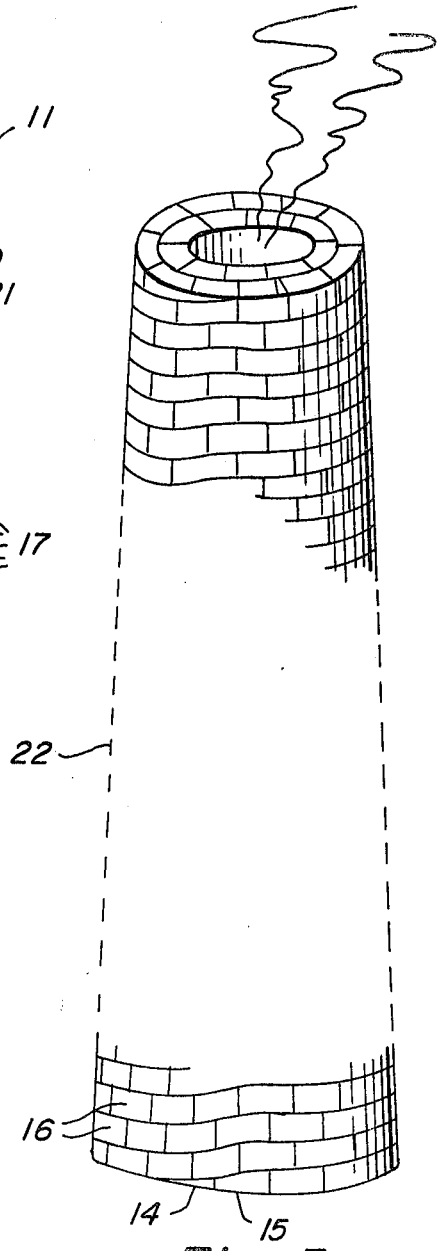
FIG. 3 shows the invention incorporated into a smokestack construction.

This method is adaptable also in laying brick one upon another, as shown in FIG. 3 so as to lay a smokestack chimney 22. In the figure, the parts referred to with numerals shown in FIGS. 1, 2 and 4 are the same. Here a helix is achieved instead of a spiral in a horizontal plane.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A method of laying a brick surface around an area, which comprises:

laying at least one continuous concentric row of brick around said area, said laying including starting said row of brick with a pointed wedge-shaped brick followed by a plurality of progressively tapered bricks until the last of said tapered bricks attains a width equal to the width of standard conventional bricks, said standard bricks being then used to complete the laying process, whereby a brick surface by way of laying at least one continuous row of brick can be laid without cutting and fitting, wherein said area is an approximately horizontal area, said area being a swimming pool.

2. A method of laying bricks as recited in claim 1, wherein said at least one row of brick includes a plurality of adjacent continuous rows of brick and said laying includes starting each of said rows of brick with one wedge-shaped brick followed by a plurality of progressively tapered bricks until the last of said tapered bricks attains a width equal to the width of standard bricks, said standard bricks being then used to complete the laying process, whereby the laying of adjacent rows may be laid by a plurality of brick layers working simultaneously, and equal to the number of rows being laid.

3. A method of laying bricks around an area, which comprises:

laying a plurality of continuous concentric adjacent rows of brick in an approximately horizontal surface around said area, said laying including starting each of said rows of brick with one wedge-shaped brick followed by a plurality of progressively tapered bricks until the last of said bricks attains a width equal to the width of standard bricks, said standard bricks being then used to complete the laying process, whereby the laying of the adjacent rows of brick may be laid by a plurality of bricklayers equal to the number of rows simultaneously and whereby said rows of brick can be laid continuously without cutting and fitting, wherein said area is a swimming pool and said bricks form a coping around said pool.

* * * * *